US006725850B2

(12) United States Patent
Kurasawa et al.

(10) Patent No.: US 6,725,850 B2
(45) Date of Patent: Apr. 27, 2004

(54) GAS-LIQUID SEPARATION DEVICE IN A VIBRATOR ENGINE

(75) Inventors: Ryoji Kurasawa, Tokyo (JP); Shigeatsu Hongo, Tokyo (JP); Satoshi Ishida, Tokyo (JP); Masaaki Higuchi, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/350,035

(22) Filed: Jan. 24, 2003

(65) Prior Publication Data

US 2003/0140910 A1 Jul. 31, 2003

(30) Foreign Application Priority Data

Jan. 31, 2002 (JP) ..... 2002-024510

(51) Int. Cl.[7] ..... F01M 13/00
(52) U.S. Cl. ..... 123/572
(58) Field of Search ..... 123/572–574

(56) References Cited

U.S. PATENT DOCUMENTS 4,459,966 A * 7/1984 Sakano et al. ..... 123/573
4,597,372 A * 7/1986 Furukawa ..... 123/572
5,957,118 A * 9/1999 Tateno et al. ..... 123/573
6,412,478 B1 * 7/2002 Ruehlow et al. ..... 123/572
6,435,170 B1 * 8/2002 Hamelink et al. ..... 123/572

FOREIGN PATENT DOCUMENTS

JP 6-6177 2/1994
JP 10-176518 6/1998

* cited by examiner

*Primary Examiner*—Marguerite McMahon
(74) *Attorney, Agent, or Firm*—McGinn & Gibb, PLLC

(57) ABSTRACT

In a gas-liquid separation device in a vibrator engine according to the present invention, a crank chamber and a rocker chamber communicate with each other through an oil delivery passage, and a push rod chamber and the crank chamber communicate with each other through an oil chamber and an oil discharge port. Oil mist generated in the crank chamber flows into the rocker chamber through the oil delivery passage, as the oil discharge port begins to resist the flow. The mist flows into the push rod chamber after the mist is made into liquid for lubrication of parts to be lubricated. Thus, the oil is returned to the crank chamber from the oil delivery passage through the rocker chamber, the push rod chamber, and the oil chamber to form a circulating path. Accordingly, a larger quantity of oil than the required quantity is not stored in the rocker chamber, and a preferable amount of gas-liquid separation may be obtained even when effects caused by vigorous vertical vibration of a vibrator make the oil stored in the rocker chamber strongly shake.

17 Claims, 7 Drawing Sheets

GAS-LIQUID SEPARATION DEVICE IN A VIBRATOR ENGINE

The disclosure of Japanese Patent Application No. 2002-024510 filed on Jan. 31, 2002 including the specification, drawings and abstract is incorporated herein by reference in its entirety.

BACKGROUND OF THE INVENTION

1. Field of the Invention

The present invention relates to a gas-liquid separation device, which efficiently separates an oil mist from blow-by gas flowing into a rocker chamber, in a vibrator engine.

2. Description of the Related Art

Recently, some overhead valve (OHV) engines have been using a dip lubrication method by which a stir is provided in a crank chamber to generate a large amount of oil mist, and the oil mist lubricates moving parts provided in the crank chamber and a rocker chamber, and the inner peripheral surface of a cylinder bore. Also, the above engines have been installed with a breather device in which blow-by gas filled in the crank chamber is led to an intake system for re-combustion, using a pulsation generated in the crank chamber.

However, since a large amount of oil mist is included in the blow-by gas in the OHV engines adopting the dip lubrication method, it is required to separate the oil mist from the blow-by gas when the blow-by gas is led to the breather chamber.

Thereby, in conventional OHV engines adopting the dip lubrication method, the rocker chamber functions as a gas-liquid separation chamber, the rocker chamber and the crank chamber communicate with each other through an oil delivery passage and an oil return passage, the oil mist which has been directed through the oil delivery passage is separated from the blow-by gas after the mist is made into liquid in the rocker chamber, and the separated oil is returned to the crank chamber through the oil return passage. On the other hand, the blow-by gas is led to the breather chamber from which the gas is sent to the intake system for re-combustion, and gas-liquid separation of the gas is further performed when the gas flows into the breather chamber.

Here, a general multipurpose engine, which is under a fixed-type use, has adopted a configuration in which a breather chamber is provided at one side which is at the downstream side of an oil return passage and near a crank chamber, for example, as disclosed in Japanese Utility Patent Publication No. 6-6177.

However, when a breather chamber is provided at the downstream side of an oil return passage, satisfactory gas-liquid separation may not be obtained even by vigorous vertical vibration, for example, in an engine which is installed in a vibrator such as a rammer (hereinafter referred to as "vibrator engine").

Accordingly, in the vibrator engine, the breather chamber is provided on the top of a rocker chamber, that is, at a position which is at the greatest distance from a crank chamber, for example, as disclosed in Japanese Unexamined Patent Application Publication No. 10-176518, in order to obtain satisfactory gas-liquid separation.

However, the technology disclosed in Japanese Unexamined Patent Application Publication No. 10-176518, in which a large quantity of oil is returned from the oil return passage to the rocker chamber by vigorous vertical vibration during operation of the vibrator, the oil easily remains in the rocker chamber, and it becomes more difficult to adequately separate oil from the blow-by gas flowing into the breather chamber, has a disadvantage that the gas-liquid separation effect is reduced by half.

SUMMARY OF THE INVENTION

The object of the present invention is to provide a gas-liquid separation device which is installed in a vibrator engine and in which an amount of oil larger than a required quantity does not remain in a rocker chamber, and gas-liquid separation can be adequately performed in the rocker chamber, even when the device is installed in a vibrator, such as a rammer, with vigorous vertical vibration.

The present invention is characterized in that an oil chamber communicates with the downstream side of the oil return passage, and the oil chamber and the crank chamber communicate with each other through an oil discharge port, in a gas-liquid separation device in a vibrator engine, in which a crank chamber and a rocker chamber communicate with each other through an oil delivery passage and also through an oil return passage, a gas-liquid separation chamber, which separates blow-by gas generated in said crank chamber from oil included in said blow-by gas, is formed in said rocker chamber, and said rocker chamber and an intake system communicate with each other through a breather device.

In such a configuration, since at least one oil chamber is inserted to the downstream side of the oil return passage through which the rocker chamber and the crank chamber communicate with each other, and the oil chamber which is located at the most downstream position and the crank chamber communicate with each other through the oil discharge port, oil is prevented from flowing from the oil return passage into the rocker chamber to cause oil flow in one direction by which the oil is supplied from the oil delivery passage to the rocker chamber. Then, oil stored in the rocker chamber is returned to the crank chamber through the oil discharge port after the oil flows into the oil chamber, passing through the oil return passage.

The above and other objects, features and advantages of the invention will become more clearly understood from the following description by referring to the accompanying drawings.

DETAILED DESCRIPTION OF THE PREFERRED EMBODIMENTS

Figure 1:
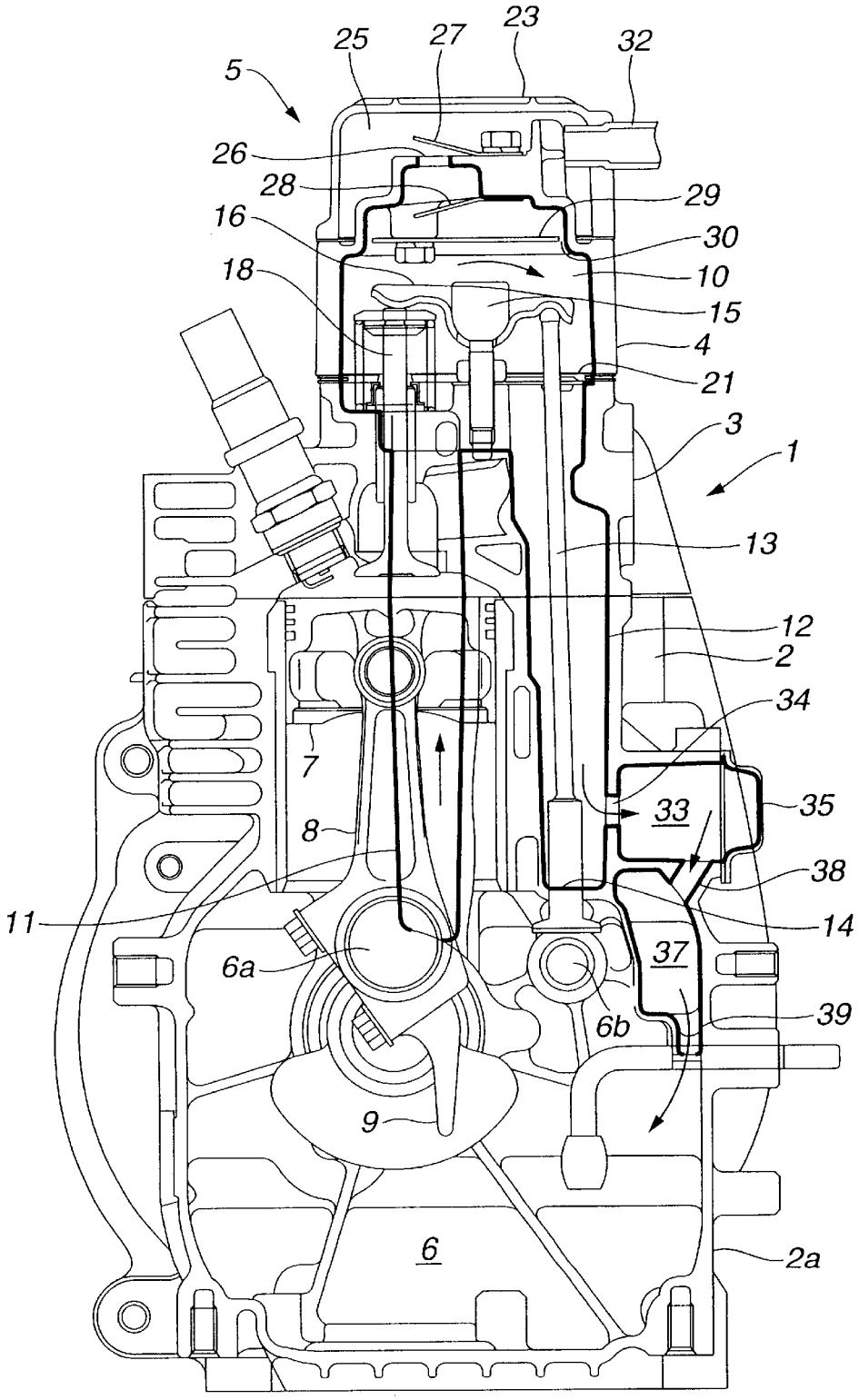
FIG. 1 is a sectional view of an engine from the front.

Reference numeral 1 indicates an OHV (overhead valve) engine which is installed in a vibrator such as a rammer and comprises: a cylinder block 2; a cylinder head 3 which is fixed to the top of the cylinder block 2; and a breather device 5 which is fixed on the cylinder head 3 through a rocker cover 4.

A crankcase 2*a* is formed as one body at the lower part of the cylinder block 2. The crankcase 2*a* has at one side thereof an opening which is closed with a crankcase cover 2*b* to form a crank chamber 6, and oil is stored in the crank chamber 6. Also, a crank shaft 6*a* and a cam shaft 6*b* are individually provided in the crank chamber 6 in a transverse manner, and a piston 7 is connected to the crank shaft 6*a* through a connecting rod 8.

Reference numeral 9 indicates a scraper which is fixed to the lower end of the connecting rod 8. When the engine is operated, the scraper 9 scrapes oil together which is stored in the crank chamber 6 to lubricate parts, such as the inner wall of a cylinder, the crankshaft 6*a*, and the cam shaft 6*b*, which are required to be lubricated, and to generate oil mist.

Moreover, a rocker chamber 10 formed in the rocker cover 4, and the crank chamber 6 communicate with each other through an oil delivery passage 11 passing through the cylinder block 2 and the cylinder head 3. In addition, a push rod chamber 12 is formed as a continuous space with the cylinder block 2 and the cylinder head 3, respectively. The push rod chamber 12 is formed in a bag configuration by which the rod chamber has an opening to the rocker chamber 10 at the upper end thereof. Here, the push rod chamber 12 is provided with a function as an oil return passage.

Also, a plurality of push rods 13 are inserted into the push rod chamber 12, and the lower ends of the push rods 13 are connected, respectively, to an intake cam and an exhaust cam (both cams are not shown) formed on the cam shaft 6*b* through a couple of tappets 14 which are movably supported in the push rod chamber 12.

On the other hand, the upper end of each push rod 13 protrudes into the rocker chamber 10. The rocker chamber 10 contains a plurality of rocker arms 16 which are supported by rocker shafts 15, and the upper end part of each push rod 13 and a stem end of an intake valve (or an exhaust valve) 18 rest on the both ends of the rocker arms 16, respectively.

Figure 6:
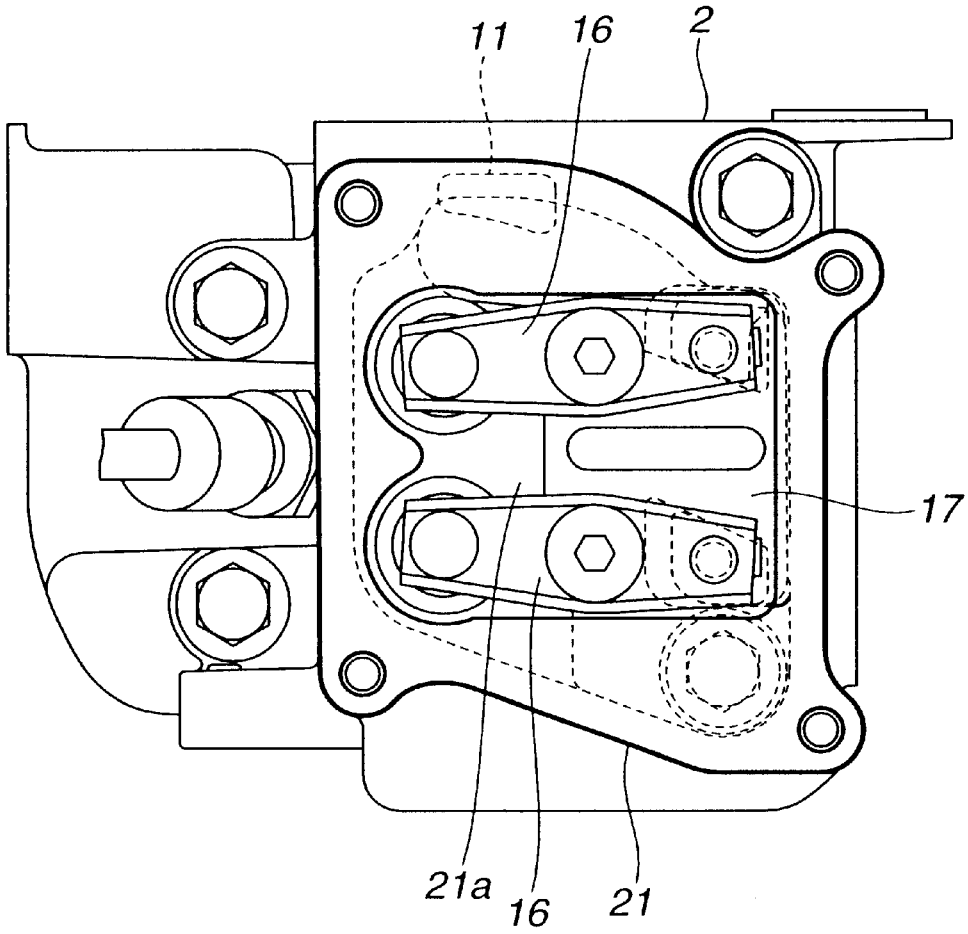
FIG. 6 is a plan view of the cylinder head.
Figure 7:
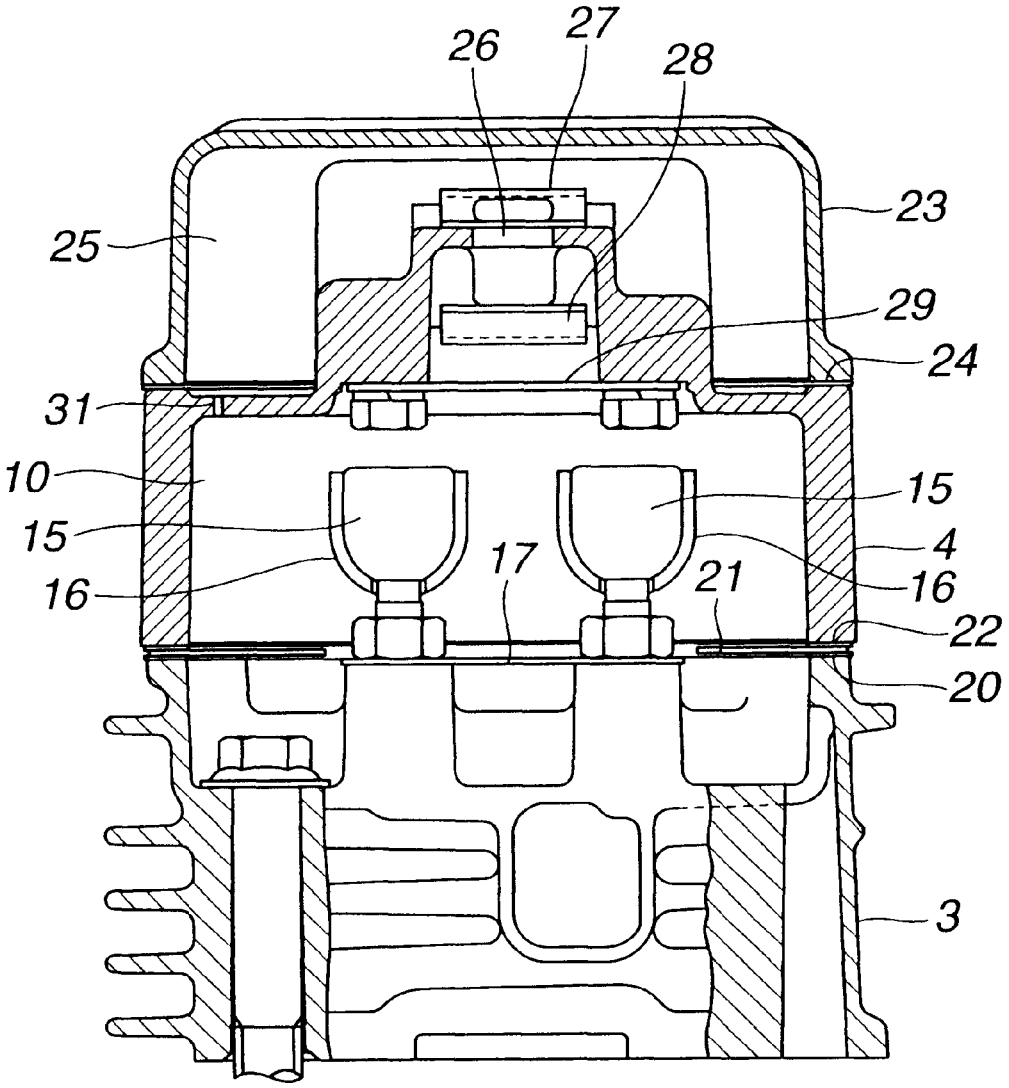
FIG. 7 is a partial sectional view of FIG. 5 from the right side.

Moreover, as shown in FIG. 6 and FIG. 7, a guide plate 17 guiding the push rods 13 are fastened and fixed at positions slightly lower positions of the upper end surface of the cylinder head 3 with nuts 19 which fix the rocker shaft 15.

In addition, a gasket 20, a baffle plate 21 to prevent the oil flow from, for example, the oil delivery passage 11, and a gasket 22 are inserted between the upper end surface of the cylinder head 3 and the lower end surface of the rocker cover 4 in such a manner that the plate 21 is put on the gasket 20, and the gasket 22 is put on the plate 21 after the gasket 20 is put on the cylinder head 3.

The baffle plate 21 is of a plate-like member which is made of sheet metal and the like and, as shown in FIG. 6 and FIG. 7, secures an area which is larger in comparison with that of the gasket 20 on the cylinder head 3 to cover the upper end surface of the cylinder head 3. The inner periphery of the plate 21 protrudes inward from the inner periphery wall of the cylinder head 3 at the upper end to form an opening 21*a* which is formed in such a way that approximately the all parts of the rocker arm 16 are exposed.

On the other hand, a breather cover 23 forming the breather device 5 is installed on the rocker cover 4 through a gasket 24, and a breather chamber 25 is formed by enclosing the chamber with the upper part of the rocker cover 4 and the breather cover 23.

The breather chamber 25 and the rocker chamber 10 communicate with each other through a blow-by passage 26 opening to the upper part of the rocker cover 4, and a reed valve 27 which opens and closes the blow-by gas passage 26 by a change in the pressure difference between the pressure of the rocker chamber 10 and that of the breather chamber 25 is disposed on the blow-by gas passage 26 along the breather chamber 25.

Figure 5:
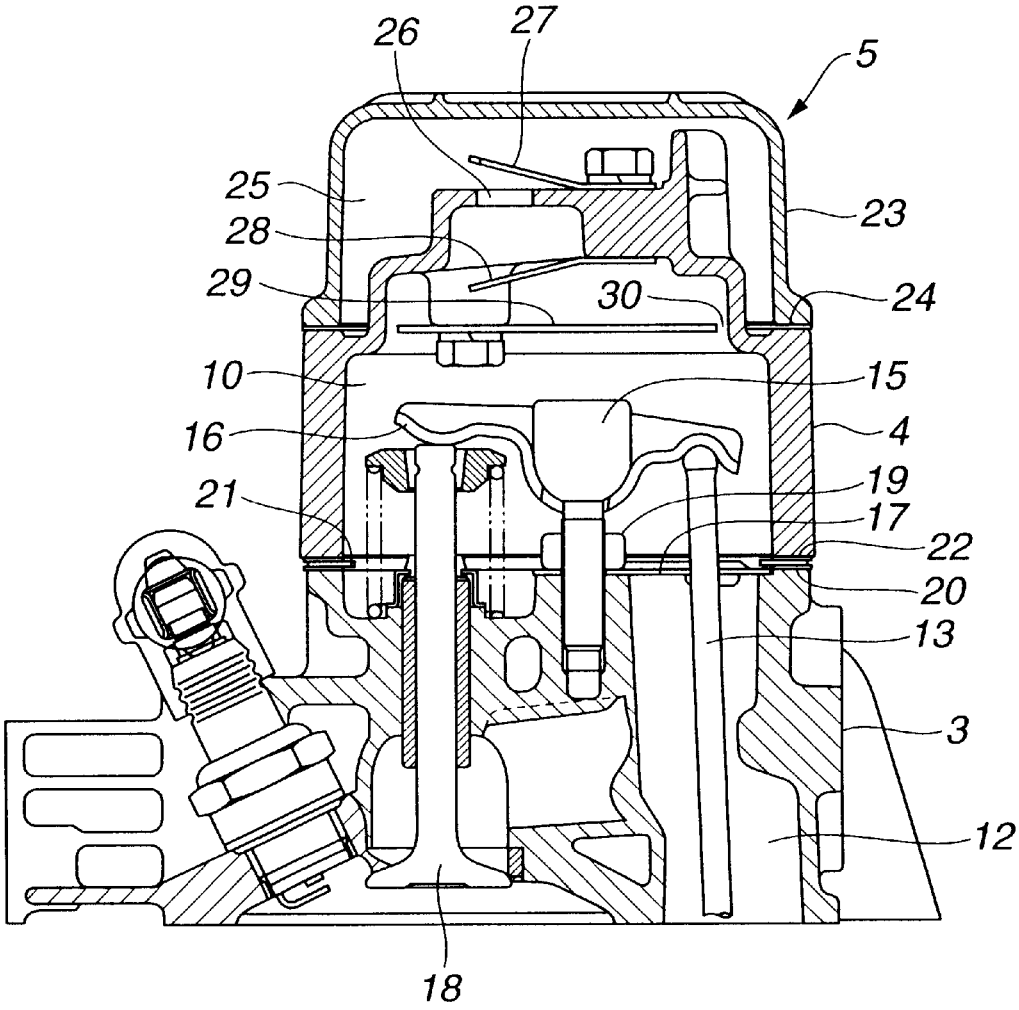
FIG. 5 is a longitudinal sectional view of a cylinder head, a rocker cover and a breather device.

Then, a first oil barrier plate 28 is disposed at a part, which is above the rocker chamber 10 and communicates with the blow-by gas passage 26, and, furthermore, a second oil barrier plate 29 is disposed below the first oil barrier plate 28. The second oil barrier plate 29 has a larger area than that of the first oil barrier plate 28, and, as shown in FIG. 5, breathers 30 are formed between the right and left, in the figure, end surfaces of the second oil barrier plate 29 and the inner wall of the rocker chamber 10.

In addition, a return hole 31 to drop oil, which has been made into liquid in the breather chamber 25, to the rocker chamber 10, is pierced in the side part of the rocker cover 4, as shown in FIG. 7. As shown in FIG. 1, a breather pipe 32 to return blow-by gas in the breather chamber 25 to the intake system is connected to one side of the breather cover 23.

Figure 2:
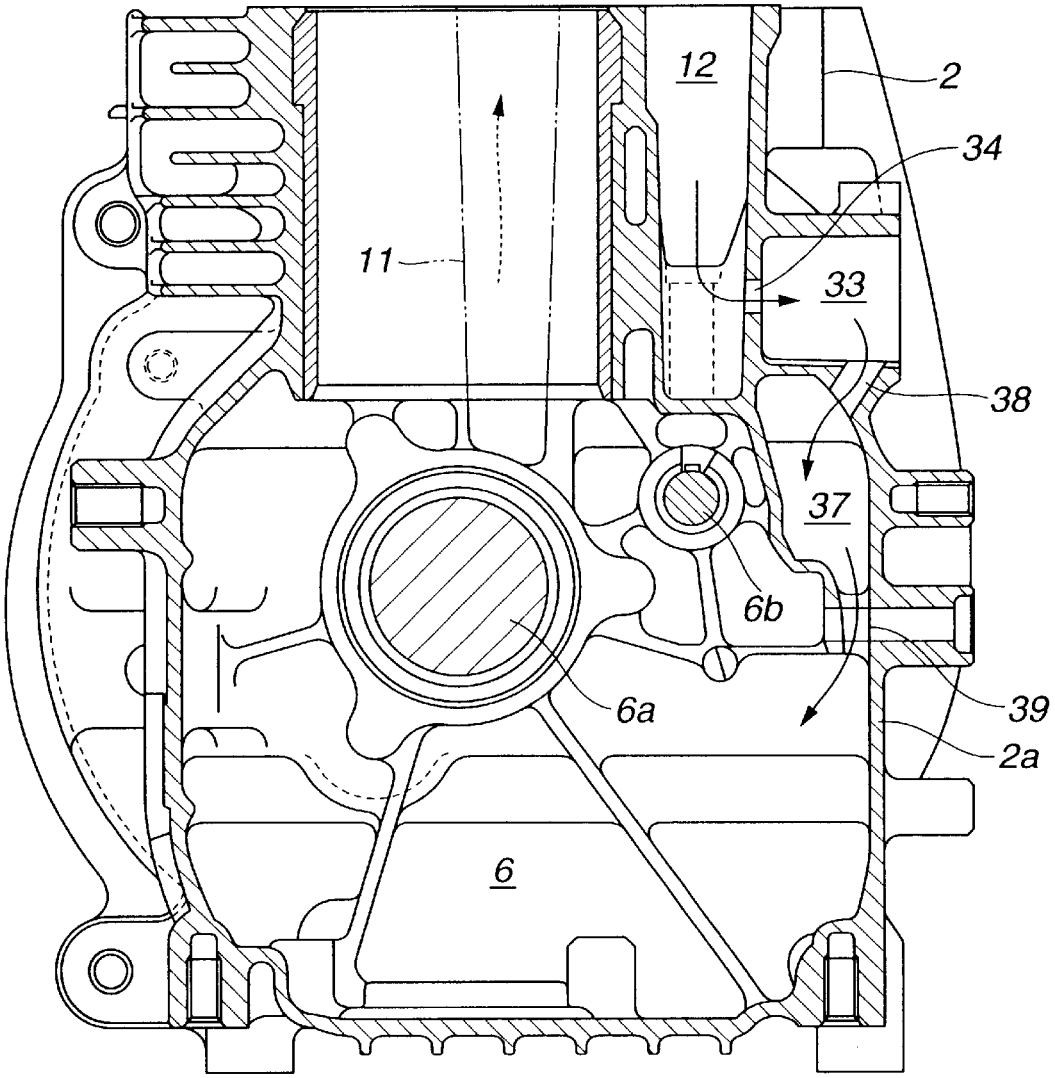
FIG. 2 is a longitudinal sectional view of a cylinder block from the front.
Figure 3:
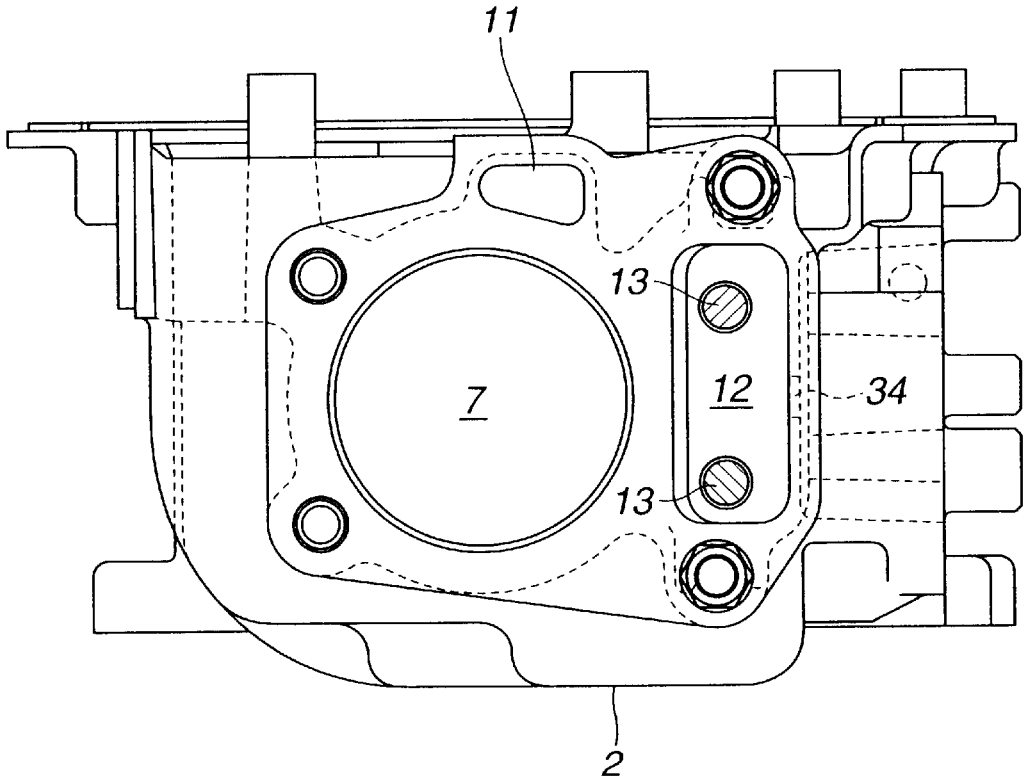
FIG. 3 is a plan view of a cylinder block.
Figure 4:
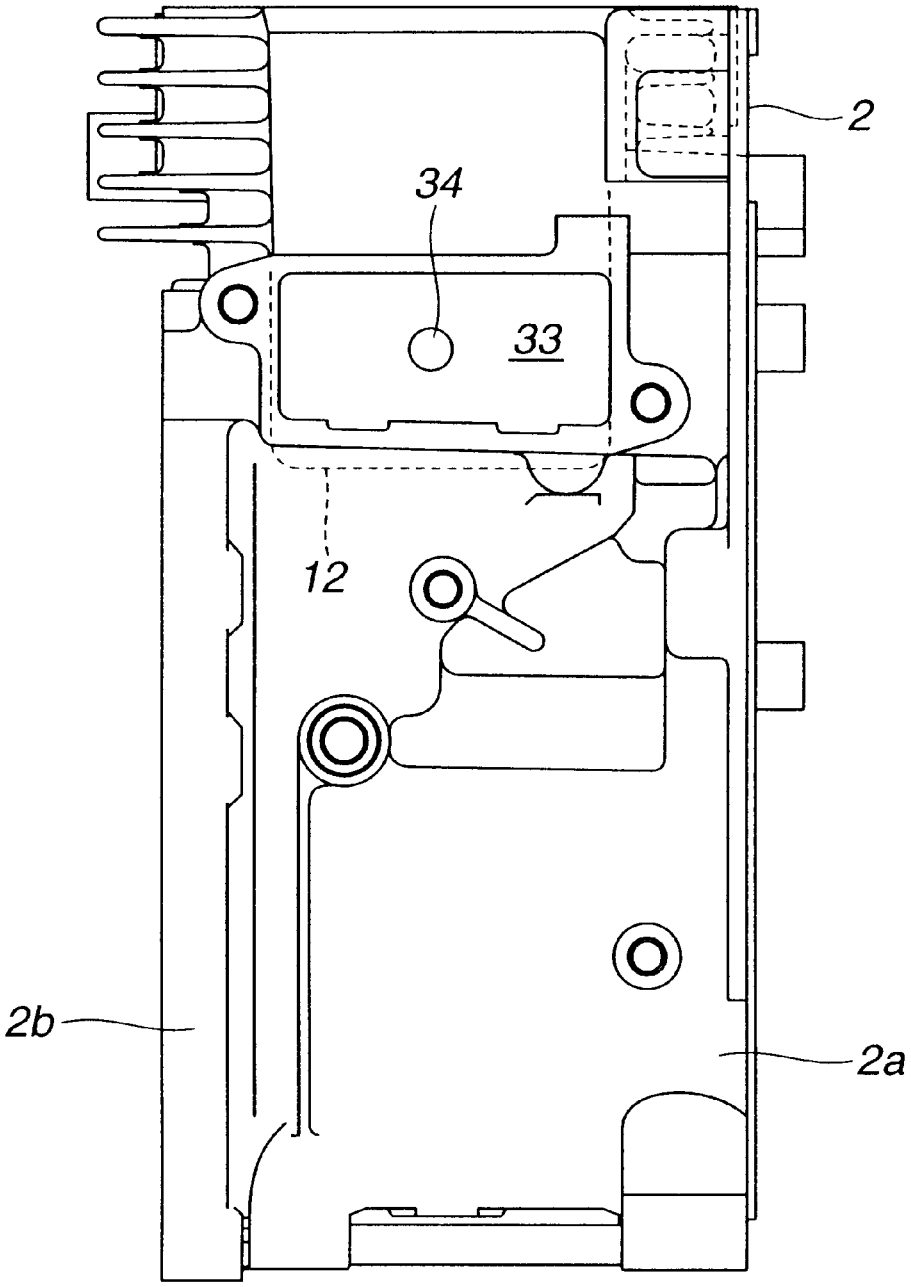
FIG. 4 is a side view of FIG. 2 from the right side.

As shown in FIG. 2, a first oil chamber 33 is formed at one side slightly above the bottom part of the push rod chamber 12 which is pierced in the cylinder block 2, and the first oil chamber 33 and the one side of the bottom of the push rod chamber 12 communicate with each other through an oil port 34. Here, one side of the first oil chamber 33 is open to the outside, and the opening is closed with a cover 35 (refer to FIG. 1), as shown in FIG. 4.

Furthermore, a second oil chamber 37 is formed below the first oil chamber 33, and both oil chambers 33 and 37 communicate with each other through an oil port 38. An oil discharge port 39, which communicates with the crank chamber 6, is pierced in the bottom of the second oil chamber 37.

Next, the operation of the above configuration according to the present embodiment will be explained.

When the OHV engine 1 which is installed in a vibrator such as a rammer is operated, oil stored in the crank chamber 6 is scraped by the scraper 9 which is fixed at the big end of the connecting rod 8, and, furthermore, parts, such as the inner wall of the cylinder, the crankshaft 6*a*, and the cam shaft 6*b*, which are required to be lubricated, are lubricated after a large amount of oil mist is generated by vigorous vertical vibration of the vibrator in the crank chamber 6 and adheres to the above parts.

Also, the oil mist and the blow-by gas which fill the crank chamber 6 are directed through the oil delivery passage 11, which passes through the cylinder block 2 and the cylinder head 3, in the direction to the rocker chamber 10 by pressure fluctuation, which is caused by reciprocating motion of a piston 7, in the crank chamber 6.

In such a case, the push rod chamber 12 and the crank chamber 6 communicate with each other through two oil chambers 33 and 37, two oil ports 34 and 38, and the oil discharge port 39, and the above ports 34, 38, and 39 become resistant against flow of oil and gas. Furthermore, it becomes difficult for the oil and the blow-by gas in the crank chamber 6 to flow from the push rod chamber 12 into the rocker chamber 10 even when the oil in the crank chamber 6 is blown off in the direction to the second oil chamber 37 from the oil discharge port 39, as the above second oil chamber 37 and the first oil chamber 33 become expansion chambers to buffer oil blowing-off. Accordingly, most of the oil mist and the blow-by gas flow into the rocker chamber 10 through the oil delivery passage 11.

Then, most of the oil mist which flows into the rocker chamber 10 through the oil delivery passage 11 is returned into the crank chamber 6 by the baffle plate 21 disposed at the lower part of the rocker chamber 10. That is, as a vibrator such as a rammer has been generally used with some inclination in many cases, it may be assumed that most of the large amount of oil mist generated in the crank chamber 6 collides with the wall surface of, for example, the oil delivery passages 11 to become liquid oil, and the liquid oil is directed along the above wall surface of the above passage in the direction to the rocker chamber 10.

As the baffle plate 21 has an opening in which the inner periphery of the plate 21 protrudes inward from the inner periphery of the cylinder head 3 at the upper end as shown in FIG. 6 and FIG. 7, most of the oil mist collides with the lower surface of the baffle plate 21 to become liquid drops which are returned to the crank chamber 6, even if the oil adhered to the wall surface of the oil delivery passage 11, and the oil mist near the wall surface is directed by the vigorous vertical vibration of the vibrator.

Since the oil mist, and the blow-by gas may be led to the rocker chamber 10 only from the opening 21*a* of the baffle plate 21, a suitable quantity of oil may be supplied to the rocker chamber 10 to prevent excessive supply of oil thereto.

The pressure quickly changes in the rocker chamber 10, and the blow-by gas and the oil mist repeatedly collide with each other and with the wall surface of the rocker chamber 10 by the change in the pressure. Accordingly, most of the oil mist with a larger particle size than that of the blow-by gas are made into liquid drops, and only a small amount of the oil mist flows into the breather chamber 25.

In such a case, since a suitable quantity of oil is adjusted to be supplied at any time to the rocker chamber 10, it is possible to make the blow-by gas, after preferable gas-liquid separation, flow into the breather chamber 25 without unnecessary mixing between the oil and the blow-by gas, even when effects caused by vigorous vertical movement of the vibrator make the oil stored in the rocker chamber 10 strongly shake.

In this case, the volume of the rocker chamber 10 may be controlled to be minimized as the gas-liquid separation chamber, as the baffle plate 21 prevents in advance a large amount of oil mist from entering into the rocker chamber 10, and raising of oil from the push rod chamber 12.

On the other hand, the oil which has been made into liquid in the rocker chamber 10 lubricates the parts, such as the rocker shaft 15, the rocker arm 16, and the intake valve (or the exhaust valve) 18, which are required to be lubricated and flows in the direction to the oil delivery passage 11 and the push rod chamber 12. At this time, as the oil mist and the blow-by gas from the crank chamber 6 are directed to the oil delivery passage 11 to prevent dropping of the oil, relatively a larger amount of oil drops into the push rod chamber 12.

Then, the oil which dropped into the push rod chamber 12 is stored in the bottom of the push rod chamber 12 and flows into the first oil chamber 33 through the oil port 34 pierced into the side wall of the chamber 12. The oil stored in the first oil chamber 33 flows into the second oil chamber 37 through the oil port 38. Subsequently, the oil stored in the second oil chamber 37 is returned to the crank chamber 6 through the oil discharge port 39.

Thus, as shown by the arrows shown in FIG. 1, the oil from the crank chamber 6 flows from the oil delivery passage 11 into the rocker chamber 10, drops in the direction towards the push rod chamber 12 from the rocker chamber 10 and is stored in the oil chambers 33 and 37, and the oil stored in the second oil chamber 37 is returned to the crank chamber 6 through the oil discharge port 39 in such a way that a circulating path is formed. Thus, a larger quantity of oil than the required quantity is not stored in the rocker chamber 10, and a preferable amount of gas-liquid separation may be obtained in the rocker chamber 10.

Here, the oil stored in the oil chambers 33 and 37 is dropped into the crank chamber 6 by its own weight even when the engine stops.

Thus, as the oil mist is supplied from the side of the oil delivery passage 11 to the rocker chamber 10, and the oil which has been made into liquid in the rocker chamber 10 is dropped mainly from the side of the push rod chamber 12 to form the circulating path in the present embodiment, a larger quantity of oil than the required quantity is not stored in the rocker chamber 10. Thus, a preferable amount of gas-liquid separation may be obtained without unnecessary mixing between the oil and the blow-by gas which has flown into the rocker chamber 10, even when effects caused by vigorous vertical vibration of the vibrator make the oil stored in the rocker chamber 10 strongly shake.

On the other hand, when the pressure in the rocker chamber 10 is higher in the breather device 5 than that of the breather chamber 25, the reed valve 27 opens due to the pressure difference. The blow-by gas bypasses the oil barrier plates 28 and 29 and flows into the breather chamber 25 through the blow-by gas passage 26. When the blow-by gas collides with the oil barrier plates 28 and 29, the fine oil mist included in the blow-by gas is made into liquid for separation.

Then, when the blow-by gas which has flown into the breather chamber 25 collides with the inner wall of the breather cover 23, a small amount of the oil mist included in the blow-by gas is further made into liquid drops, and the blow-by gas after predetermined gas-liquid separation is led into the intake system through the breather pipe 32 for re-combustion. Here, the oil which has been made into liquid drops in the breather chamber 25 is dropped from the oil return hole 31 (refer to FIG. 7) to the rocker chamber 10.

Moreover, the present invention is not limited to the above-described embodiment, and, for example, the oil return passage may be formed in such a way that the passage is independent of the push rod chamber. Furthermore, the number of oil chambers may be one, or more than three oil chambers may be formed to communicate with each other.

Having described the preferred embodiments of the invention referring to the accompanying drawings, it should be understood that the present invention is not limited to those precise embodiments and various changes and modifications thereof could be made by one skilled in the art without departing from the spirit or scope of the invention as defined in the appended claims.

As explained above, a preferable amount of gas-liquid separation may be obtained according to the present invention, while a larger quantity of oil than the required quantity is not stored in the rocker chamber, and the volume of the rocker chamber may be controlled to be minimized even when the device is installed in a vibrator, such as a rammer, with vigorous vertical vibration.

What is claimed is:

1. A gas-liquid separation device in a vibrator engine, comprising:

an oil delivery passage through which a crank chamber and a rocker chamber communicate with each other;

an oil return passage through which said crank chamber and said rocker chamber communicate with each other;

a gas-liquid separation chamber formed in said rocker chamber, wherein said gas-liquid separation chamber separates blow-by gas generated in said crank chamber from oil included in said blow-by gas;

a breather device through which said rocker chamber and an intake system communicate with each other;

a first oil chamber which communicates with a downstream side of said oil return passage; and an oil discharge port through which said first oil chamber and said crank member communicate with each other, wherein a second oil chamber is inserted between said downstream side of the oil return passage and said first oil chamber.

2. A gas-liquid separation device in a vibrator engine, comprising:

an oil delivery passage through which a crank chamber and a rocker chamber communicate with each other, wherein said rocker chamber is formed on a top of a cylinder head;

an oil return passage through which said crank chamber and said rocker chamber communicate with each other;

a gas-liquid separation chamber formed in said rocker chamber, wherein said gas-liquid separation chamber separates blow-by gas generated in said crank chamber from oil included in said blow-by gas;

a baffle plate which is inserted between said rocker chamber and said cylinder head, wherein an inner periphery of the baffle plate protrudes inwardly from an inner periphery wall of said cylinder head to form an opening in said baffle plate;

a breather device through which said rocker chamber and an intake system communicate with each other;

an oil chamber which communicates with a downstream side of said oil return passage; and an oil discharge port through which said oil chamber and said crank member communicate with each other.

3. The gas-liquid separation device in a vibrator engine according to claim 2, wherein a second oil chamber is inserted between said downstream side of the oil return passage and said oil chamber.

4. The gas-liquid separation device in a vibrator engine according to claim 2, wherein said rocker chamber includes a plurality of rocker arms therein, and wherein said opening is formed such that said plurality of rocker arms are exposed.

5. The gas-liquid separation device in a vibrator engine according to claim 2, wherein said rocker chamber contains rocker arms substantially adjacent to said opening.

6. The gas-liquid separation device in a vibrator engine according to claim 2, wherein said baffle plate is situated between a first gasket and a second gasket.

7. The gas-liquid separation device in a vibrator engine according to claim 2, wherein said baffle plate comprises sheet metal.

8. The gas-liquid separation device in a vibrator engine according to claim 2, wherein said rocker chamber is formed in a rocker cover, said baffle plate and a pair of gaskets are situated between an upper end surface of said cylinder head and a lower end surface of said rocker cover.

9. The gas-liquid separation device in a vibrator engine according to claim 2, wherein said cylinder head is covered by a gasket, and wherein said baffle plate comprises an area greater than an area of said gasket.

10. The gas-liquid separation device in a vibrator engine according to claim 2, wherein said baffle plate is disposed at a lower portion of said rocker chamber.

11. The gas-liquid separation device in a vibrator engine according to claim 2, wherein said oil and said blow-by gas enter said rocker chamber through said opening so that said oil forms liquid drops in said rocker chamber.

12. The gas-liquid separation device in a vibrator engine according to claim 2, wherein said rocker chamber comprises a controllable volume to adjust said gas-liquid separation chamber.

13. The gas-liquid separation device in a vibrator engine according to claim 2, wherein said breather device comprises a breather chamber, said breather chamber communicates with said rocker chamber through a blow-by passage.

14. A gas-liquid separation device in an engine, comprising:

an oil delivery passage through which a crank chamber and a rocker chamber communicate with each other, wherein said rocker chamber is formed on a top of a cylinder head;

an oil return passage through which said crank chamber and said rocker chamber communicate with each other;

a gas-liquid separation chamber formed in said rocker chamber, wherein said gas-liquid separation chamber separates blow-by gas generated in said crank chamber from oil included in said blow-by gas;

a baffle plate which is inserted between said rocker chamber and said cylinder head, wherein an inner periphery of the baffle plate protrudes inwardly from an inner periphery wall of said cylinder head to form an opening in said baffle plate; and a breather device through which said rocker chamber and an intake system communicate with each other.

15. The gas-liquid separation device in a vibrator engine according to claim 14, further comprising:

an oil chamber which communicates with a downstream side of said oil return passage.

16. The gas-liquid separation device in a vibrator engine according to claim 15, wherein a second oil chamber is inserted between said downstream side of said oil return passage and said oil chamber.

17. The gas-liquid separation device in a vibrator engine according to claim 14, wherein said rocker chamber includes a plurality of rocker arms therein, and wherein said opening is formed such that said plurality of rocker arms are exposed.

* * * * *